US005322061A

United States Patent [19]

Brunson

[11] Patent Number: 5,322,061

[45] Date of Patent: Jun. 21, 1994

[54] DISPOSABLE AEROSOL MASK

[75] Inventor: Kevin K. Brunson, Argyle, Tex.

[73] Assignee: Tecnol Medical Products, Inc., Fort Worth, Tex.

[21] Appl. No.: 991,154

[22] Filed: Dec. 16, 1992

[51] Int. Cl.[5] ..... A62B 7/10

[52] U.S. Cl. ..... 128/206.13; 128/863; 2/424

[58] Field of Search ..... 128/863, 206.13, 206.12, 128/206.19, 201.17, 201.25, 201.29; 2/DIG. 7, 184, 336, 243 A, 243 R

[56] References Cited

U.S. PATENT DOCUMENTS

| | | | |
|---|---|---|---|
| D. 327,141 | 6/1992 | Hubbard et al. | D29/9 |
| 1,987,922 | 1/1935 | Blatt | 128/863 |
| 2,116,241 | 5/1938 | Heumann | 128/863 |
| 2,494,406 | 1/1950 | Reitano | 128/206.13 |
| 3,170,461 | 2/1965 | Watts | 128/863 |
| 4,323,063 | 4/1982 | Fisichella | 128/863 |
| 4,417,575 | 11/1983 | Hilton | 128/206.19 |
| 4,419,993 | 12/1983 | Petersen | 128/201.15 |
| 4,419,994 | 12/1983 | Hilton | 128/206.19 |
| 4,600,002 | 7/1986 | Maryyanek et al. | 128/206.19 |
| 4,606,341 | 8/1986 | Hubbard et al. | 128/206.19 |
| 4,688,566 | 8/1987 | Boyce | 128/206.19 |
| 4,802,473 | 2/1989 | Hubbard et al. | 128/206.19 |
| 4,969,457 | 11/1990 | Hubbard | 128/206.12 |
| 5,020,533 | 6/1991 | Hubbard et al. | 128/206.23 |
| 5,033,115 | 7/1991 | Bowling | 2/51 |
| 5,150,703 | 9/1992 | Hubbard et al. | 128/206.12 |

FOREIGN PATENT DOCUMENTS

| | | | |
|---|---|---|---|
| 8900874 | 2/1989 | World Int. Prop. O. | 128/206.13 |

OTHER PUBLICATIONS

Tecnol Fluidshield Surgical Masks Featuring Splash-Guard Visors brochure, Tecnol, Inc. Nov. 1992.

The Mask Collection TECNOL brochure, *AORN Journal*, 1987.

Annotated Figure from U.S. 4,419,993.

*Primary Examiner*—Edgar S. Burr
*Assistant Examiner*—Eric Raciti
*Attorney, Agent, or Firm*—Baker & Botts

[57] ABSTRACT

A disposable mask that includes a filter media capable of filtering particles of a size appropriate for its purposes, while providing excellent breathability. The mask is formed from multiple layers of filtration material having the general configuration of a trapezoid. The mask is secured by straps to the head of a wearer. The straps are arranged to be approximately coextensive with a line extending from the edges which define the opening of the mask so that the edges are pulled into tight sealing engagement with the face of the wearer.

38 Claims, 4 Drawing Sheets

DISPOSABLE AEROSOL MASK

RELATED APPLICATIONS

This application is related to U.S. patent application Ser. No. 29/002,694, filed Dec. 16, 1992 by Kevin K. Brunson and entitled "Particulate Face Mask" and U.S. Pat. No. Des. 347,090 issued May 17, 1994 and filed Dec. 16, 1992 by Kevin K. Brunson and entitled "Particulate Face Mask and Neck Shield".

TECHNICAL FIELD OF THE INVENTION

This invention relates generally to a face mask capable of preventing passage of airborne aerosol particles. More particularly, and not by way of limitation, this invention relates to a disposable face mask having a relatively low pressure drop to permit easy breathing, while preventing aerosol particles from passing therethrough and therearound.

BACKGROUND OF THE INVENTION

Disposable masks have been manufactured for many years. In the medical field, most of these masks have been for use in preventing contamination of a patient by the breath of healthcare personnel. In recent years with increased concern for infection of healthcare personnel with airborne pathogens, such as the hepatitis B virus, it has become necessary to prevent not only the contamination of patients due to exhalation from healthcare personnel, but also to prevent infection of healthcare personnel due to inhalation of airborne infection particles. It has become even more important in view of the advent of human immunodeficiency virus (HIV) and the recent increase in infectious tuberculosis associated with many HIV patients.

In addition, it has been found that aerosols having airborne liquid and solid particles are generated not only by the exhalation of infected patients, but also by certain procedural manipulations and processes that impart energy to any microbial suspension. Surgical procedures involving use of drills and saws are particularly prolific producers of the aerosols which may contain tuberculosis, HIV or other pathogens from an infected patient. Concern with tuberculosis has been increasing since new strains of the disease show strong resistances to multiple types of drug treatment.

In addition, it has been shown that many of the viral hemorrhagic fevers such as yellow fever, Rift Valley fever and perhaps Rocky Mountain spotted fever, rabies and smallpox can be transmitted through aerosols. A considerable number of studies have been made which are now beginning to identify the transmission of such viruses through "non-accident" situations. Accordingly, it is now believed that many of those "non-accident" situations result from aerosol contamination.

Of the current medical masks on the market, it appears that many are not effective against aerosols. One of the presently available molded-type surgical masks has almost no resistance to particles smaller than 2 microns and has a low efficiency in blocking particles as large as 9 microns. Some masks apparently demonstrate somewhat better qualities, but none appeared to be fully satisfactory in preventing the passage of aerosols through the mask or around the periphery of the mask.

One type of mask is illustrated in U.S. Pat. No. 2,012,505 issued on Aug. 27, 1935 to S. J. Goldsmith. Another type of disposable face mask is illustrated in U.S. Pat. No. 4,319,567. This mask is molded and has been especially configured in an effort to avoid the leakage of the flow of gases past the edges of the mask. Obviously, leakage cannot be tolerated when attempting to control aerosols. U.S. Pat. No. 4,606,341 issued Aug. 19, 1986 to Vance M. Hubbard and Welton K. Brunson shows a conventional rectangular face mask having a trapezoidal pleat. Rectangularly shaped masks, including the mask shown in patent '341, have less than the optimal fit to prevent the passage of aerosols between the periphery of the masks and a wearer's face. An additional folded type mask is illustrated in U.S. Pat. No. 4,688,566 issued Aug. 25, 1987 to Elvin L. Boyce. This patent illustrates another attempt to prevent the flow of fluids past the edges of a mask.

Therefore, a need has arisen for a mask which will prevent the passage of aerosols through the mask and maintain the ability of the mask to provide a sufficiently low pressure drop so that the wearer can breathe comfortably. A further need has arisen for a mask to seal totally around the periphery of the mask to prevent bypass of aerosols between the edges of the mask and the face of a wearer.

SUMMARY OF THE INVENTION

In one aspect, this invention provides a disposable mask comprising a filter body that is sized to cover the nose and mouth of a wearer. The body has top and bottom edges with the top edge arranged to extend across the bridge of the nose of the wearer and the bottom edge arranged to extend under the wearer's chin. A first securing member is attached to the body adjacent each end of the top edge and is disposed generally about the back of the head of the wearer in an approximate linear continuation of the top edge urging the top edge into tight engagement with the wearer's face to prevent fluid flow between the top edge and the wearer's face. A second securing member is attached to the body adjacent to each end of the bottom edge and disposed generally over the top of the wearer's head in an approximate linear continuation of the bottom edge urging the bottom edge into tight engagement with the wearer to prevent fluid flow between the bottom edge and the wearer's face.

In another aspect, the invention contemplates the method of making a disposable aerosol mask that includes a plurality of layers of selected materials, comprising the steps of placing first and second inner mask layers with generally trapezoidal shapes in juxtaposition to form the inside surface of the mask, placing a first outer mask layer of generally trapezoidal shape in juxtaposition with the first inner mask layer to form a top outside surface of the mask, placing a second outer mask layer of generally trapezoidal shape in juxtaposition with the second inner mask layer to form a bottom outside surface of the mask, connecting the first and second inner and outer mask layers along three sides of the generally trapezoidal shape to form a top edge and a bottom edge along an unconnected side of the generally trapezoidal shape, securing an elongated malleable member along the top edge, and attaching securing means for holding the mask on a wearer between the layers adjacent to junctions of the top and bottom edges.

The present invention has significant technical advantages in that a face mask is provided for forming a barrier with the face of a wearer to prevent passage of aerosols between the periphery of the mask and the wearer's face. The general trapezoidal shape of the face mask cooperates with inner and out radii on opposite sides of the mask to provide a relatively flat sealing surface with the face of a wearer. The face mask also provides substantially increased flow area for the passage of air through the mask during normal breathing by the wearer while at the same time allowing the use of filtration media having higher resistance to the passage of aerosols through the mask. The present invention allows optimizing the filtration capability for resistance to the passage of aerosols while minimizing the restriction of normal breathing caused by wearing the mask.

In accordance with another aspect of the invention, a malleable nose piece or member is provided with optimum dimensions as compared to the dimensions of the top edge of the mask to provide an enhanced fluid barrier between the periphery of the mask and the wearer's face. Proper selection of the dimensions of the malleable member substantially reduces blow-by between the top edge of the mask and the wearer's nose and face.

Another significant technical advantage of the present invention is that a face mask is provided which has the capabilities of providing enhanced filtration for particulate matter in the size range of 1 micron to 0.1 microns. The present invention allows for optimization of the overall performance characteristics of the mask depending upon the particular operating environment in which the wearer will use the mask. The present invention allows optimizing filtration capability with respect to particulate matter, liquids, and aerosols along with minimizing resistance to normal breathing activity of the wearer.

Another significant technical advantage of the present invention is providing a mask with an enlarged filtration area which substantially improves breathability through the mask while at the same time allowing the use of filtration media having enhanced capability to remove submicron particulate matter. The trapezoidal shape of the mask in accordance with the present invention allows for increased surface flow area which reduces the resistance to air passage through the filter media associated with normal breathing. The trapezoidal shape in cooperation within other features of the invention results in a face mask with off-the-face benefits of a molded-cone style mask and can still be carried in the pocket of a wearer prior to use. The trapezoidal shape along with inward and outward radii on opposite sides of the mask cooperate to allow optimizing the dimension of the mask to form a tight seal with the wearer's face and to prevent collapse of the mask during normal breathing.

A further technical advantage of the present invention is the alternating arrangement of the mask layers on sheets of raw material during the cut out process. The alternating layout arrangement produces very little scrap and very little wasted material during manufacture and assembly of the mask. This represents not only cost saving to the manufacturer, but also represents an environmentally desirable situation since there is less scrap material which must be incinerated or otherwise disposed.

The present invention allows for a substantially improved fit between the periphery of the mask and the contours of a wearer's face.

BRIEF DESCRIPTION OF THE DRAWINGS

For a more complete understanding of the present invention and the advantages thereof, reference is now made to the following description taken in conjunction with the accompanying drawings, in which.

DETAILED DESCRIPTION OF THE INVENTION

Figure 1:
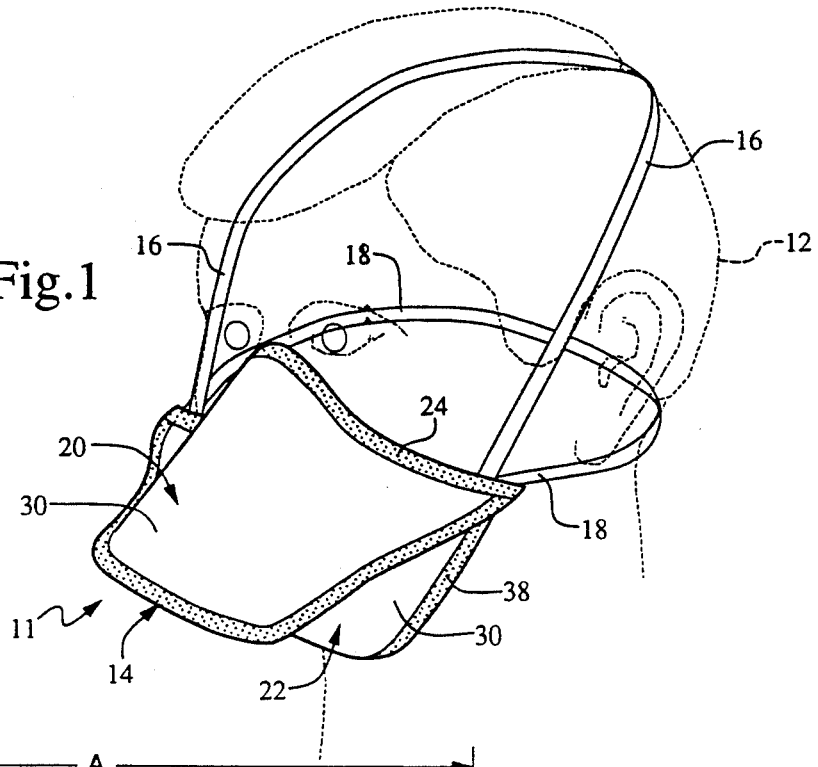
FIG. 1 is a perspective view of a mask or respirator constructed in accordance with the invention and illustrated as being disposed on the head of a wearer.
Figure 2:
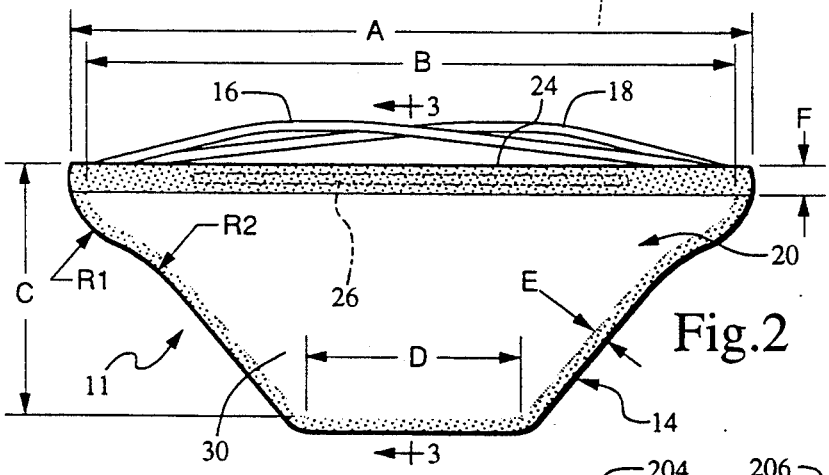
FIG. 2 is the top plan view of the mask of FIG. 1.
Figure 3:
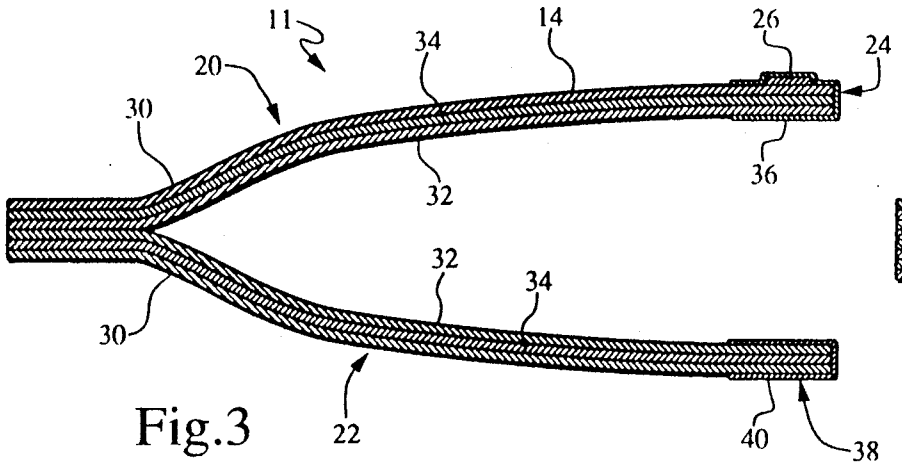
FIG. 3 is a cross sectional view of the mask of FIG. 1 taken generally along the line 3—3 of FIG. 2.

Referring to the drawings and to FIGS. 1-3 in particular, shown therein and generally designated by the reference numeral 11, is a mask that is constructed in accordance with the invention. Mask 11 is illustrated as being positioned on the face of wearer 12 shown in ghost lines. Mask 11 includes filter body 14 that is secured to wearer 12 by means of resilient and elastic straps or securing members 16 and 18. Filter body 14 comprises an upper portion 20 and a lower portion 22 (shown in FIG. 1) which have a generally trapezoidal configuration. Upper and lower portions 20 and 22 may have an identical configuration and are preferably bonded together such as by heat and/or ultrasonic sealing along three sides. Bonding in this manner adds important structural integrity to mask 11.

The fourth side is open and includes a top edge 24 that is arranged to receive an elongated malleable member 26 (see FIGS. 2 and 3). Malleable member 26 is provided so that top edge 24 of mask 11 can be configured to closely fit the contours of the nose and cheeks of wearer 12. Malleable member 26 is preferably constructed from an aluminum strip with a rectangular cross-section, but may also be a moldable or malleable steel or plastic member. With the exception of having malleable member 26 located along top edge 24 of upper portion 20 of mask 11, upper and lower portions 20 and 22 may be identical.

Top edge 24 of upper portion 20 and bottom edge 38 of lower portion 22 cooperate with each other to define the periphery of mask 11 which contacts the face of wearer 12. The present invention allows optimizing the barrier formed between the periphery of mask 11 and the face of wearer 12 and the filtration capability of mask 11 to resist the passage of particular matter and aerosols through filtration media 34 while minimizing resistance to normal breathing of wearer 12 resulting from the use of mask 11.

Figure 6:
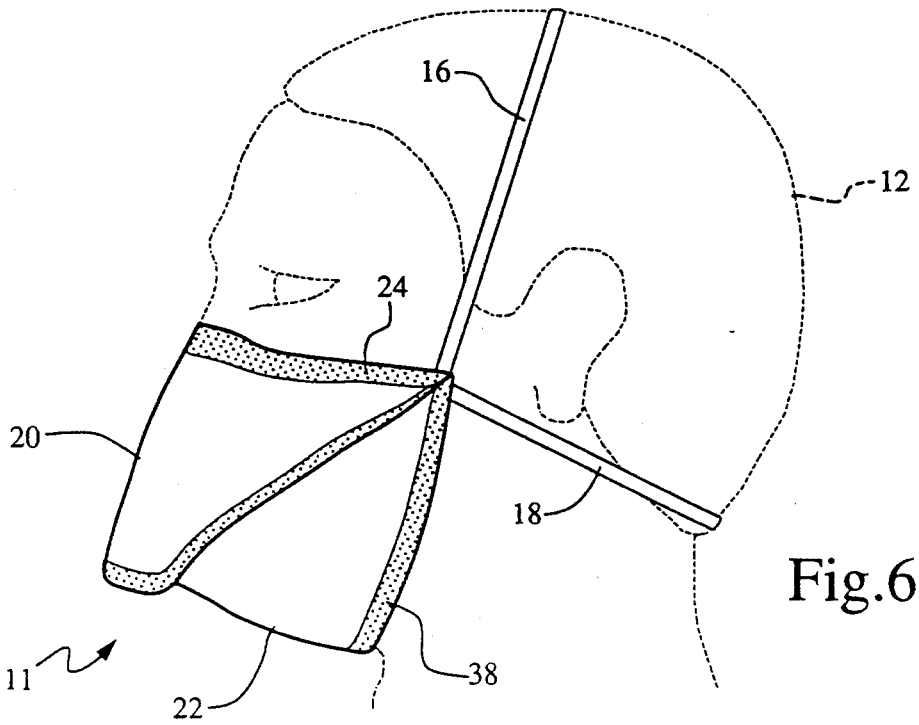
FIG. 6 is a side view of the mask of FIG. 1 located on the head of the wearer.
Figure 10:
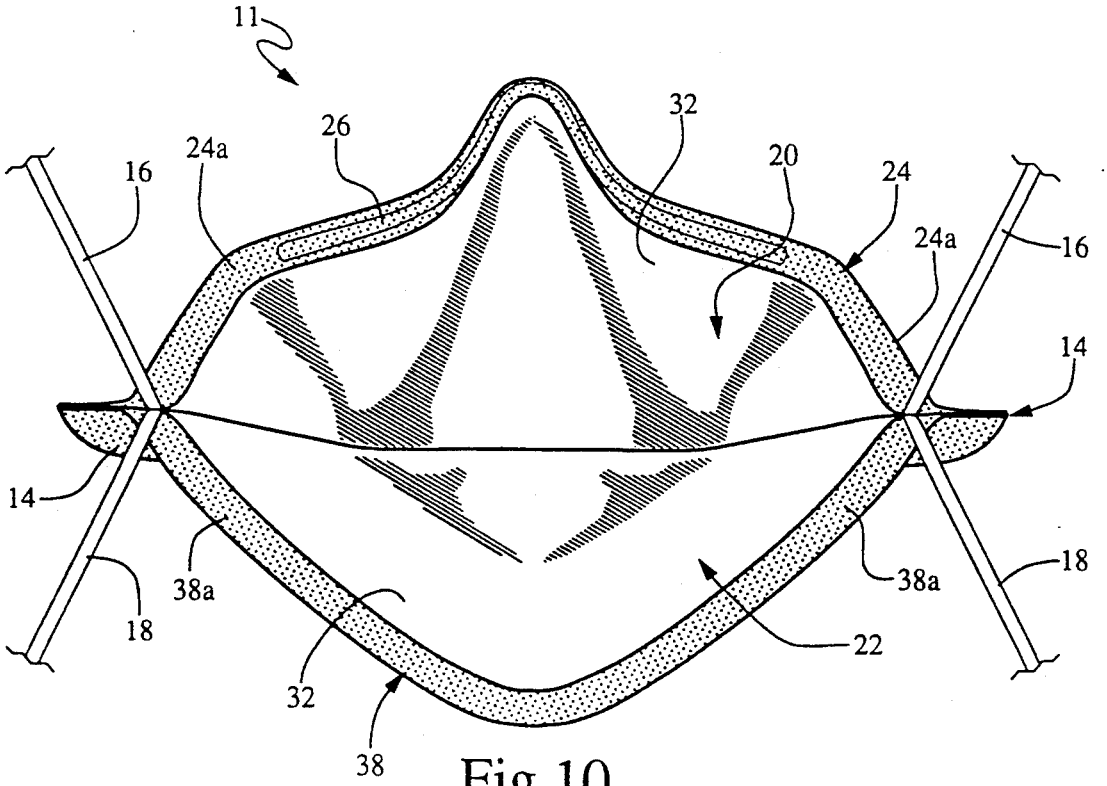
FIG. 10 is an isometric view of the mask of FIGS. 1, 6 and 8 showing interior portions of the mask and the relatively flat surfaces near the periphery of the mask which form a fluid barrier with the wearer's face.

As shown in FIGS. 1, 6 and 10, mask 11 has the general shape of a cup or cone when placed on the face of wearer 12. The present invention allows mask 11 to provide "off-the-face" benefits of a molded-cone style mask while still being easy for wearer 12 to carry mask 11 in a pocket prior to use. "Off-the-face" style masks provide a larger breathing chamber as compared to soft, pleated masks which contact a substantial portion of the wearer's face. Therefore, "off-the-face" masks permit cooler and easier breathing. The present invention also allows optimizing the volume of air contained within filter body 14. If the volume is too large, excessive amounts of exhaled air may be retained within filter body 14 at normal breathing rates. By properly selecting the size of filter body 14, excessive heating of the air within filter body 14 is minimized and dizziness from prolonged periods of rebreathing exhaled air is minimized.

Optimum dimensions for mask 11 as shown in FIG. 2 include the major length, dimension A, of the trapezoidal shape of filter body 14 is 10 ¼". The length of the opening in filter body 14 defined in part by top edge 24 and bottom edge 38, dimension B, is 9¼" due to approximately ½" of seal at each junction between upper portion 20 and lower portion 22. The minor length of the parallel portion of trapezoid shaped filter body 14, dimension D, is 3 5/16". The opening of filter body 14 defined in part by dimensions A and B is generally parallel with minor length, dimension D. The dimensions A and B may be varied by ±¾". The width of the trapezoid shape of filter body 14, dimension C, is 3½". Dimensions C and D may be varied by ±¼". The bonded border defining the three closed sides of mask 11, dimension E, is preferably ¼" in width. Top edge 24 and bottom edge 38 which contact the wearer's face, dimension F, are preferably ½" in width.

The above dimensions may be modified to accommodate wearers having smaller or larger facial features. However, the ratio between the width of the trapezoid shape which defines mask 11, dimension C, as compared to the minor length of the trapezoid shape, dimension D, should preferably remain at approximately 1 to 1. The preferred ratio between the major length of filter body 4, dimension A, and the minor length, dimension D, is approximately 3 to 1.

An important feature of the present invention is forming radius R1 of 1⅛" and radius R2 of 3" in the non-parallel or angled sides of filter body 14. Radii R1 and R2 cooperate with each other to prevent collapse of filter body 14 during normal breathing by wearer 12. These radii, R1 and R2, help mask 11 retain the desired, off-the-face shape during normal breathing. If the sealed border on the three closed sides of filter body 14 is less than ¼", mask 11 will also tend to collapse during normal breathing. Therefore, an important feature of the present invention is combining radii R1 and R2 with a sealed border of approximately ¼" in width to provide the desired cone or cup shaped mask covering the nose and mouth of wearer 12 and to maintain a fluid tight barrier with wearer 12's face without collapsing during normal breathing.

Radius R2 curves outward from opposite sides of mask 11 and is tangent to radius R1 that curves inward towards the attachment points for headbands 16 and 18. This arrangement is a critical feature of the present invention and serves two important functions. Radii R1 and R2 cooperate with each other to improve the facial seal performance between the periphery of mask 11 and wearer's 12 face. Radii R1 and R2 allow mask 11 to open with relatively flat surfaces 24*a* and 38*a* at each end of top edge 24 and bottom edge 38 adjacent to the attachment point for headbands 16 and 18. These flat surfaces 24*a* and 38*a* near the periphery of mask 11 are best shown in FIG. 10. These flat surfaces adjacent to the attachment point for the headbands 16 and 18 gradually taper away from the opening in filter body 14. The general trapezoidal shape of filter body 14 in cooperation with radii R1 and R2 and the other preferred dimensions and ratios cooperate to minimize collapse of filter body 14 during normal use of mask 11.

Radii R1 and R2 cooperate with top edge portion 24 and bottom edge portion 38 to allow mask 11 to fit securely with and to form a tight facial seal on a greater number of different face sizes. Mask 11 is particularly useful with smaller faces which contact the tapered surfaces adjacent to the attachment points for headbands 16 and 18 on the interior of mask 11 as shown in FIG. 10. Flat surface 24*a* and 38*a* adjacent to the attachment points for headbands 16 and 18 allows mask 11 to have a greater sealing area against the face of wearer 12. Other types of surgical masks frequently have contact between the periphery of the mask and the skin of the wearer's face at an acute angle with only the narrow, bonded edge of the mask providing a sealing surface.

Radii R1 and R2 assist in maintaining the integrity of mask 11 by providing strength along the three-bonded side of filter body 14 when mask 11 is fully opened against the face of a wearer. These previously described design features allow for the use of lighter weight or lighter basis material which adds breathability and comfort to mask 11. Without radii R1 and R2 these same lightweight materials would be prone to collapse during inhalation. The ¼" bonded seal around the three closed sides of filter body 14 contributes to maintaining structural integrity of mask 11 when secured to the face of wearer 12.

Blow-by associated with normal breathing of wearer 12 is substantially eliminated by properly selecting the dimension and location of malleable strip 26 with respect to top edge of 24. Malleable strip 26 is preferably positioned in the center of top edge 24 and has a length in the range of 50 percent to 70 percent of the total length, dimension A, of top edge 24. For one embodiment of the present invention, the performance of mask 11 was enhanced by using malleable strip 26 manufactured from quarter-tempered aluminum. For this embodiment, the length of malleable strip 26 was approximately 54 percent of the length of top edge 24 with a thickness of 0.021 inches and a width of 0.197 inches.

The present invention allows designing mask 11 with the optimum periphery to fit on the face of wearer 12 and with the optimum dimension for malleable strip 26 to form an enhanced fluid barrier with the nose and face of wearer 12. The present invention allows modification to the length of top edge 24 and bottom edge 38 while maintaining approximately the same surface area for normal breathing through filter media 34.

Elastic straps or headbands 16 and 18 are preferably constructed from resilient polyurethane, but may be constructed from elastic rubber, or a covered stretch yarn. The covered stretch yarn may consist of an elastomeric material wrapped with nylon or a polyester. As will be discussed in more detail, the use of two headbands 16 and 18 substantially improves the fluid barrier between the periphery of mask 11 and the face of wearer 12.

As illustrated in FIG. 3, the upper and lower portions 20 and 22 each include an outer mask layer 30 that is preferably constructed from a spun-bonded polypropylene. Outer mask layers 30 may also be constructed from a bi-component and/or powder bonded material such as polyethylene or polypropylene, a cellulastic tissue, or a spun-bonded polyester. Outer mask layers 30 typically have a basis weight range of 0.5 ounces per yard to 1.0 ounces per yard. 0.9 ounces per yard is one of the preferred basis weights for outer layers 30. Inner mask layers 32 are preferably composed of a bicomponent polyethylene and polypropylene. Layers 32 may also be constructed from polyester polyethylene material or cellulastic tissue. Layers 32 typically have a basis weight range of 0.4 ounce per yard to 0.75 ounces per yard. 0.413 ounces per yard is one of the preferred basis weights for layers 32. Located between outer mask layer 30 and inner mask layer 32 is an intermediate mask layer 34 that comprises the filter media for mask 11. This layer is preferably constructed from a melt-blown polypropylene, but may be constructed from an extruded polycarbonate, a melt-blown polyester, or a melt-blown urethane.

By using the generally trapezoidal shape of filter body 14 including the preferred ratios for the dimensions of filter body 14 and radii R1 and R2, a wide variety of materials may be used in the manufacturer of the layers which comprise filter body 14. The present invention has significantly increased the types of material which may be satisfactorily used in constructing filter body 14. The present invention also allows more options with respect to selecting the number of layers of material which are used to manufacturer filter body 14.

A mask with the filter media or intermediate layer 34 was selected to test filtration of particle sizes of about 1.0 micron. In tests run using standardized testing procedures for filter materials, filter media 34 had an efficiency in excess of 98 percent. The efficiency is defined by the equation $$\% \text{ Eff} = \frac{\text{Avgc} - \text{Avgt}}{\text{Avgc}}$$

where: is the particle count with no test sample in the path and Avgc is the average particle count of three runs; and t is the particle count with a test sample in the path and Avgt is the average particle count of three runs.

In the test procedure, 1.0 micron latex particles were aerosolized, dried and passed through the test samples at the rate of one cubic foot per minute. The particles were counted using a laser based particle counter.

Top edge 24 of mask 11 is faced with an edge binder 36 that extends across the open end of mask 11 and covers malleable strip 26. Similarly, lower portion 22 of mask 11 forms a bottom edge 38 that is encompassed in an edge binder 40. Edge binders 36 and 40 are preferably constructed from a spun-laced polyester material. The binders may also be constructed from a number of thermally bonded bicomponent materials or from polypropylene or polyethylene non-porous plastic films.

Referring to FIGS. 1 and 6, mask 11 is illustrated as being located on the face of wearer 12. As seen in FIG. 1, upper portion 20 with malleable member 26 located in top edge 24 conforms very closely to the configuration of the nose and cheeks of wearer 12. In FIG. 6, it can be seen that bottom edge 38 fits under the chin of wearer 12. It is very important that the fit between bottom edge 38 and the chin of wearer and top edge 24 and the nose and cheeks of the wearer fit very closely since any leaks result in bypass or blow-by of air either entering mask 11 or being discharged from mask 11 as it is used by wearer 12. Leakage around top edge 24 and bottom edge 38 reduces the effectiveness of mask 11.

Figure 8:
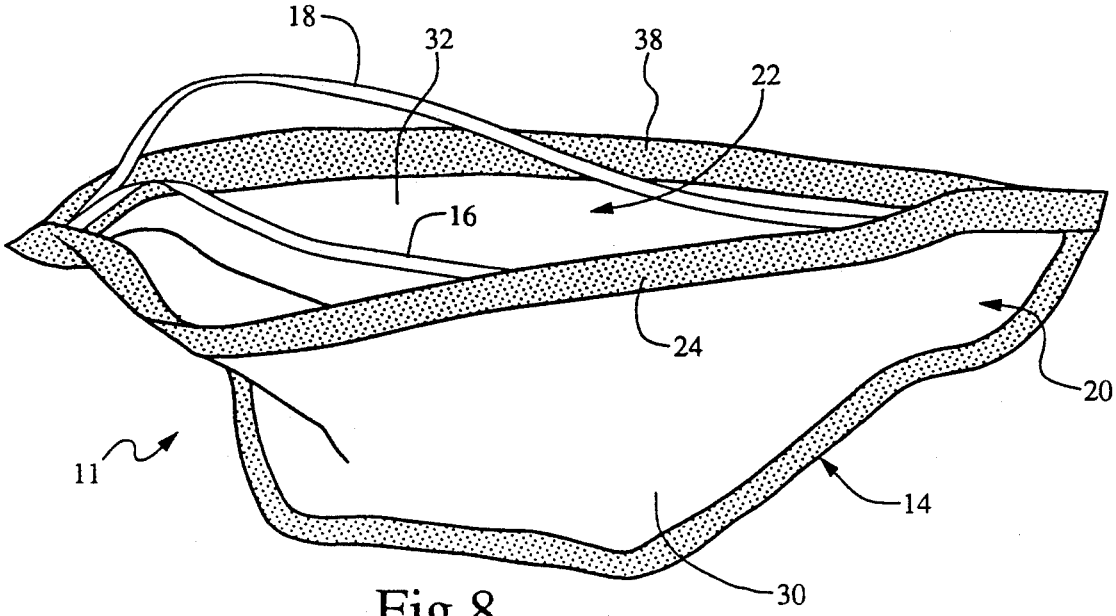
FIG. 8 is an interior view of the mask of FIGS. 1 and 6 showing the attachment of one end the first and second securing means to the body of the mask.

Accordingly, elastomeric headbands or straps 16 and 18 have their ends attached at the junctures between top edge 24 and bottom edge 38 of mask 11 as shown in FIGS. 8 and 10. The arrangement is such that strap 16 can be placed over the top of the head of wearer 12, as illustrated most clearly in FIG. 6, in alignment with bottom edge 38 of mask 20 so that a direct force is exerted along that line urging bottom edge 38 into sealing engagement with the chin of wearer 12. Similarly, strap 18 is positioned around the lower base of the skull and in direct alignment with top edge 24 of mask 11 and thus placing a force thereon which tends to move top edge 24 into tighter sealing engagement with the nose and cheeks of wearer 12. As shown in FIGS. 8 and 10, the ends of straps 16 and 18 are secured at the same location between top edge 24 and bottom edge 38 with no gap between the ends of straps 16 and 18. The position of attaching straps 16 and 18 to filter body 14 in cooperation with radii R1 and R2 results in the optimum pull angle to form a fluid tight barrier between surfaces 24*a* and 38*a* on the interior of mask 11 and the face of wearer 12.

It is extremely difficult to construct a mask that will fit the facial configuration of all wearers without constructing the mask specifically for each individual face. Los Alamos National Laboratory has established standards for the testing of face masks that utilize panels of people with different face sizes and configurations. Such facial features represent approximately 95 percent of the working population. Two different panels of people are utilized: one, according to face width and length and the other according to lip length and face length. Twenty-five panelists are utilized in each category.

During a typical test, each panelist dons a mask and a hood is placed over their head with saccharin introduced into the hood. The panelist is then asked to perform a certain routine of exercises. If the panelist tastes the saccharin, the mask fit test is a failure. Mask 11 was subjected to such testing and tested successfully on almost 90 percent of the panelists. Such results are substantially better than any of the current existing masks.

In addition to having a tight peripheral seal, it is essential that mask 11 have good breathability characteristics. That is, mask 11 should require a low differential in pressure to permit air to flow easily through filter body 14 despite the fact that mask 11 will filter 1 micron and smaller particles and have a very tight fit between edges 24 and 38 and the face of wearer 12. A low differential pressure for air flow indicates good breathability through a face mask.

Upper portion 20 and lower portion 22 of mask 11 have a combined surface area through which air can flow of about 250 square centimeters. Thus, body 14 of mask 11 has a surface area of approximately 250 square centimeters which provides enhanced breathability for wearer 12. Tests were run utilizing a flow rate of 0.32 liters per minute across the entire flow area. Approximately thirty masks incorporating the present invention were checked. The masks had a pressure differential ranging from 0.9 to 1.3 mm of water with a mean pressure differential across the mask of about 1.25 mm of water. Such a low differential in pressure across the mask provides excellent breathability characteristics despite the ability of the mask to filter one micron and smaller sized particles with essentially zero edge leakage around the periphery of mask 11.

Figure 4:
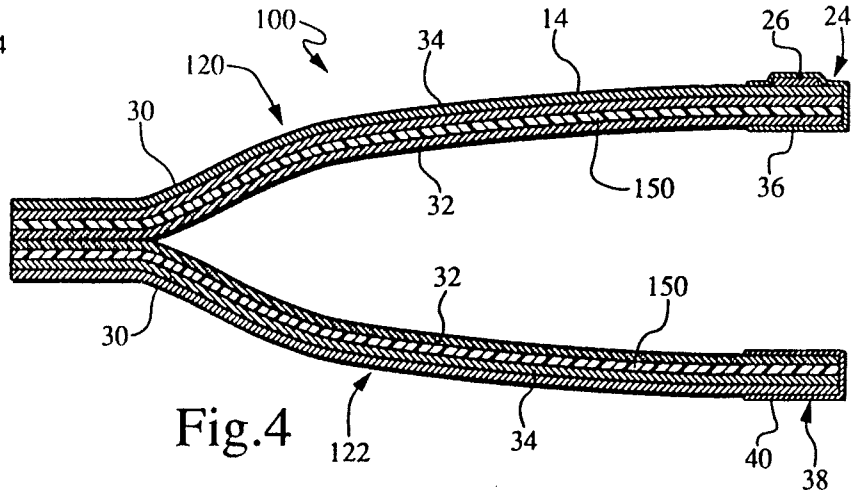
FIG. 4 is a cross-sectional view similar to FIG. 3, but showing an embodiment of mask that includes a fourth layer.

FIG. 4 illustrates mask 110 that incorporates an alternative embodiment of the present invention. The illustration of FIG. 4 is a cross-sectional view taken through mask 110 similar to FIG. 3 for mask 11 taken along the line 3—3 shown in FIG. 2. Like mask 11, mask 100 also includes an upper portion 120 and a lower portion 122.

Upper portion 120 and lower portion 122 include outer mask layers 30, inner mask layers 32 and intermediate mask layers 34 comprising part of the filter media for mask 100. In addition mask 100 includes a fourth intermediate layer 150 in both upper portion 120 and lower portion 122. Layers 150 are also generally trapezoidal in configuration and are encompassed within edge binders 36 and 40.

Layers 150 may be comprised of a material similar to that previously mentioned for layers 34. One of the preferred layers 150 is constructed from a barrier material that is gas permeable and permits gas to pass through the mask in both directions and is impermeable to liquid passing through mask 100 in at least one direction. A more complete description of the construction and operation of such a material can be found in U.S. Pat. No. 3,929,135 issued Dec. 30, 1975 to Thompson and assigned to Proctor & Gamble Co. Such materials are constructed from a low density polyethylene and include small apertures which prevent liquids from passing therethrough due to the liquid's relatively high surface tension. U.S. Pat. Nos. 4,920,960; 5,020,433 and 5,150,703 to Hubbard, et al provide additional information on the material used for layers 150 and face masks constructed with such material. These patents which are assigned to Tecnol Medical Products, Inc. are incorporated by reference for all purposes within this application. Other types of microporous film may be satisfactorily used with the present invention.

The use of layers 150 is particularly important when mask 100 is worn in an environment where the wearer may be exposed to "body fluids". These fluids such as blood, urine and saliva may contain highly contagious germs. Contact of AIDS-contaminated body fluids with another person's source of body fluids, such as the eye, nose and mouth, may transmit the disease. Therefore, it is necessary to include layers 150 which are resistant to the passage of body fluids in one direction to prevent such body fluids from contacting the nose and mouth of the wearer. Layers 150 prevent the passage of liquids from the exterior of mask 100 from contacting the face of a wearer covered by mask 100.

Figure 5:
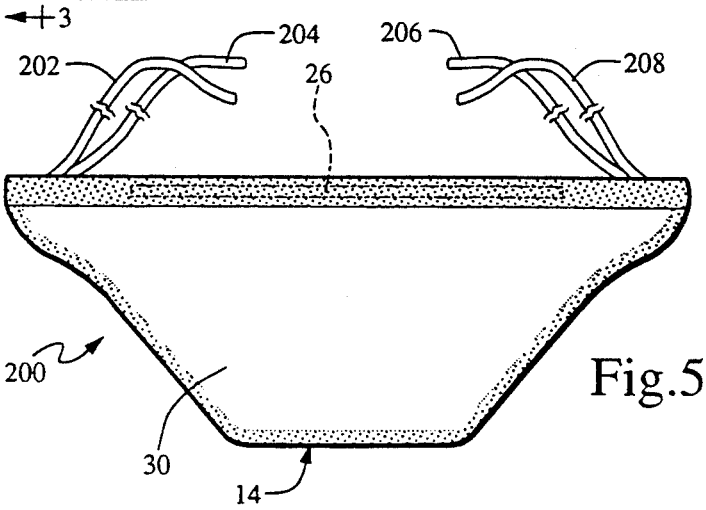
FIG. 5 is a view of another embodiment of the mask that is also constructed in accordance with the present invention.

FIG. 5 illustrates a mask generally designated by the reference character 200 that is in all respects identical to either mask 11 or mask 100 with the exception of the means for securing mask 200 on the face of wearer 12. As illustrated in FIG. 5, tie straps 202, 204, 206 and 208 are secured at the same place on mask 200 as straps 16 and 18 were secured on mask 11. In this case, tie straps 202, 204, 206 and 208 may be constructed from either resilient or non-resilient material and are positioned on the head of the wearer and tied in position by the wearer. A wide variety of materials are available for the manufacture of tie straps 202, 204, 206 and 208.

Figure 7:
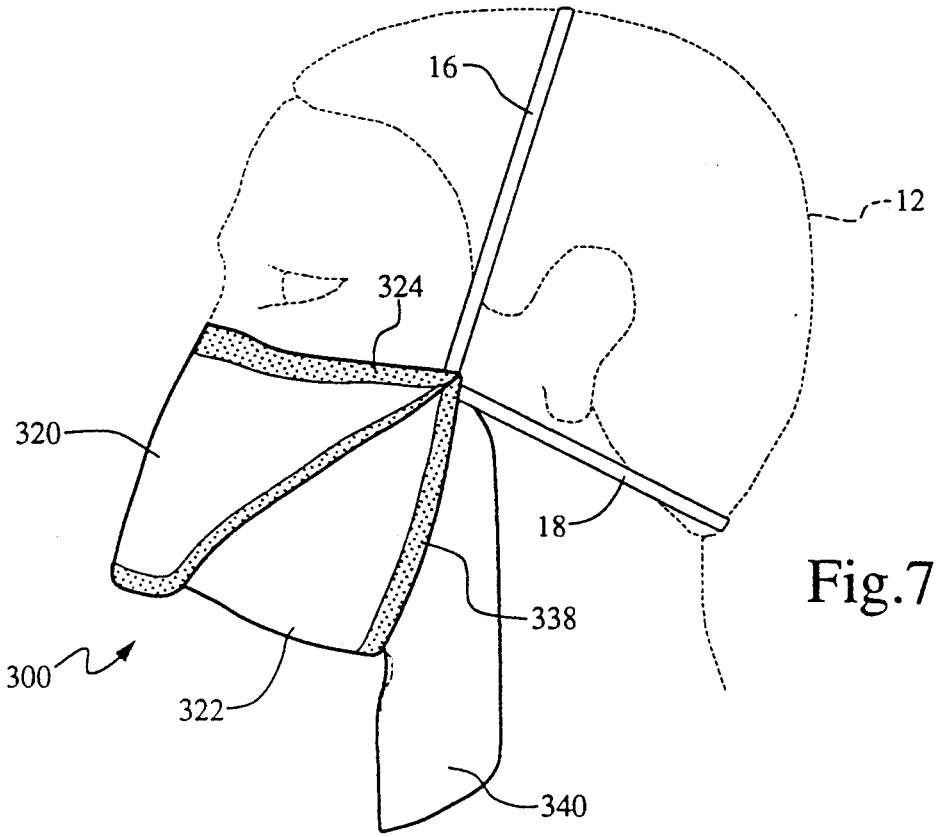
FIG. 7 is a view similar to FIG. 6 of another embodiment of the mask that is also constructed in accordance with the invention.

Tie straps 202, 204, 206 and 208 are preferably tied in such a fashion that they would have a relationship to mask 200 and the head of the wearer 12 as illustrated by head bands 16 and 18 in FIGS. 1, 6 and 7. Thus, a force is exerted by tie straps 202, 204, 206 and 208 in directions to pull the lower edge of mask 200 into sealing engagement with the jaw and cheek of the wearer and to pull the top edge into sealing engagement with the nose and cheeks of the wearer.

Tie straps 202, 204, 206 and 208 may be constructed from four separate lengths of material. Alternatively, tie straps 202 and 204 may be a single length of material which is bonded in the middle with the attachment point between upper portion 20 with lower portion 22. In the same manner a single length of material may be used to provide tie straps 206 and 208. The present invention allows two relatively long lengths of material to provide four separate ties for attaching mask 200 to the face of a wearer.

FIG. 7 illustrates a modification of mask 11 which is generally designated by the reference character 300. Mask 300 includes an upper portion 320 and a lower portion 322. Upper and lower portions 320 and 322 are preferably constructed as previously described for either mask 11 or mask 100. Upper portion 320 terminates in top edge 324 which is bound as previously described in connection with mask 11. However, the lower or bottom edge portion designated by the reference character 338 is constructed slightly differently.

Instead of terminating inner mask layer 32 of bottom portion 322 at bottom edge 338 as previously described for bottom edge 38 of mask 11, the material forming layer 32 is extended past the bottom edge 338 to form a veil or gap guard 340 that extends downwardly from mask 300 covering a portion of the neck of wearer 12. During the manufacturing process, lower edge 338 is bound by an edge binding prior to the application of inner mask layer 32 so that inner mask layer 32 is not caught up in the binding but is adhered to bottom edge 338 by ultrasonic welding or the like.

The purpose of the veil or gap guard 340 is to extend down over a beard of wearer 12 or to extend over the neck in those cases when wearer 12 dons a hood (not shown) to complete the coverage of wearer's 12 head. Veil or guard 340 prevents hair contamination from beards and skin particles which may be rubbed off by the hood from entering the working environment. Also, guard 340 will protect wearer 12's neck from undesired contact with aerosols and body fluids.

Figure 9:
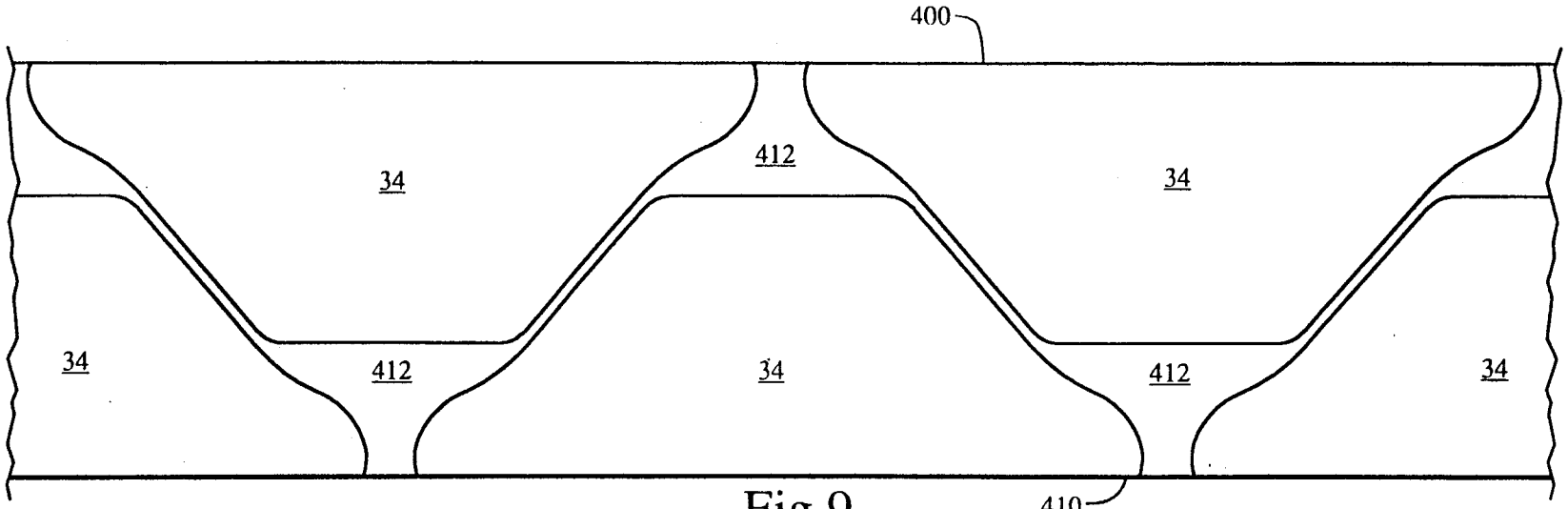
FIG. 9 is a typical layout for one of the layers of the mask of FIG. 1 on a flat sheet of material.

FIG. 9 illustrates another aspect of the invention, namely the layout of the generally trapezoidal shape for cutting mask layers from sheets of material. A typical alternating layout for layer 34 on one of the multiple sheets of material used to form mask 11 is shown. More precisely, the layouts of FIG. 9 represent the outline of cutters which ultimately cut layers 30, 32 and 34 for mask 11 from respective flat sheets of material. The layouts are arranged in an alternating pattern on the flat sheets of material between edges 400 and 410 of the sheet representing the open side of mask 11 formed by top edge 24 and bottom edge 38. The arrangement of the layouts is such that a continuous piece of scrap 412 is formed as the material is fed through the cutter (not shown) utilized in making mask 11. The alternating layout, made possible by the generally trapezoidal shape of filter body 14, produces very little scrap with very little wasted material produced during the production of mask 11, 100 and 300. This arrangement of alternating layouts represents not only cost saving to the manufacturer, but also represents an environmentally desirable situation since there is less material which must be incinerated or otherwise disposed.

Masks 11 and 100 may be assembled using the following process. Each layer 30, 32, 34 and 150 if used, is placed on its appropriate sheet of raw material in the same manner as shown for layer 34 in FIG. 9. Inner mask layer 32 for upper portion 20 is placed in juxtaposition with inner mask layer 32 for lower portion 22. The inner mask layers 32 cooperate with each other to form the inside surface of the respective mask 11 or 100. First and second intermediate layers 34 are then placed in juxtaposition with respect to the respective first and second inner mask layers 32. Outer mask layer 30 for upper portion 20 along with malleable strip 26 is then attached to the respective inner layer 34 to form top portion 20. Outer layer 30 is then attached to the respective intermediate layer 34 to form bottom portion 22. Binders 36 and 40 are secured to top edge 24 and bottom edge 38 respectively. The three sides of upper portion 20 and lower portion 22 are connected with each other by heat sealing or ultrasonic bonding to form filter body 14 having a general trapezoidal shape with an open side defined by top edge 24 and bottom edge 38. Straps 16 and 18 are then attached to the corners of top edge and bottom edge 38 at the junction with upper portion 20 and lower portion 22. In addition to intermediate layer 34, an additional intermediate layer 150 may be placed between inner layer 32 and intermediate layer 34 to form filter mask 100.

Depending upon the environment in which the finished mask will be used, intermediate layers 34 and 150 may not be required. Outer layers 30 and inner layers 32 may provide the desired amount of filtration without including one or more intermediate layers.

Although the present invention has been described in detail, it should be understood that various changes, substitutions and alternations can be made herein without departing from the spirit and the scope of the invention as defined in the following claims.

What is claimed is:

1. A disposable mask comprising:

a filter body having an opening sized to cover the nose and mouth of a wearer, said body having top and bottom edges with said top edge arranged to extend across the nose of said wearer and said bottom edge arranged to extend under the chin of said wearer;

said top edge having ends opposite from each other and said bottom edge having ends opposite from each other;

first securing means attached to said body adjacent to each end of said top edge and arranged to extend generally about the back of the head of said wearer in an approximate linear continuation of said top edge, said first securing means for urging said top edge into tight engagement with said wearer for preventing flow between said top edge and said wearer; and second securing means attached to said body adjacent to each end of said bottom edge and arranged to extend generally over the top of said wearer's head in an approximate linear continuation of said bottom edge, said second securing means for urging said bottom edge into tight engagement with said wearer for preventing flow between said bottom edge and said wearer.

2. The mask of claim 1 wherein said filter body includes:

an upper portion of generally trapezoidal configuration having a longer side forming said top edge;

a lower portion of generally trapezoidal configuration having a longer side forming said bottom edge;

said ends of said top edge being joined with said ends of said bottom edge to define in part said opening in said filter body; and said upper and lower portions being joined along all remaining sides of said filter body.

3. The mask of claim 2 wherein said filter body further comprises radii formed on opposite sides of said filter body adjacent to said top edge and said bottom edge.

4. The mask of claim 3, further comprising said malleable member located in the center of said top edge and having a length corresponding to more than 50% and less than 70% of the length of said top edge.

5. The mask of claim 1 further comprising an elongated malleable member located in said top edge for conforming said top edge to the shape of said wearer's nose and cheeks.

6. The mask of claim 1 wherein said filter body comprises a filter media having a differential pressure range for breathability of 0.9 to 1.3 mm of water.

7. The mask of claim 1 wherein said filter body comprises a filter media for restricting the flow of aerosols therethrough that are greater than one micron in size.

8. The mask of claim 1 wherein said securing means comprise one-piece elongated members connected to said filter body intermediate the ends of said one-piece elongated members.

9. The mask of claim 1 wherein said securing means comprise first and second elongated, flexible members connected respectively to said filter body.

10. The mask of claim 1 wherein said filter body comprises an intermediate layer of material that is gas permeable in both directions through said body and liquid impermeable from the exterior of said filter body.

11. A disposable mask comprising:

a filter body having an opening sized to cover the nose and mouth of a wearer, said filter body having top and bottom edges with said top edge arranged to extend across the nose and cheeks of said wearer, and said bottom edge arranged to extend under the chin of said wearer;

said top edge having ends opposite from each other and said bottom edge having ends opposite from each other, said ends of said top edge being joined with said ends of said bottom edge to define in part said opening in said filter body;

said filter body comprising an upper portion of generally trapezoidal configuration having a longer side forming said top edge and a lower portion of generally trapezoidal configuration having a longer side forming said bottom edge;

said upper and lower portion being joined along all remaining sides; and a plurality of radii formed on opposite sides of said filter body.

12. The mask of claim 11 further comprising an elongated malleable member located in said top edge for conforming said top edge to the shape of said wearer's nose and cheeks.

13. The mask of claim 12, further comprising said malleable member located in the center of said top edge and having a length corresponding to more than 50% and less than 70% of the length of said top edge.

14. The mask of claim 11 wherein said filter body further comprises:

a first radius that curves inward towards said top edge; and a second radius that curves outward from said filter body.

15. The mask of claim 14 wherein said filter body further comprises said second radius tangent to said first radius.

16. The mask of claim 11 further comprising:

a first securing means and a second securing means for attaching the mask to the face of said wearer; and said first securing means and said second securing means attached to said filter body at said ends of said top edge and said bottom edge.

17. The mask of claim 16 further comprising said ends of said first securing means and said second securing means disposed adjacent to each other between said ends of said top edge and said bottom edge respectively.

18. The mask of claim 11 wherein said filter body further comprises:

first securing means attached to said body adjacent to each end of said top edge and positioned to extend generally about the back of the head of said wearer in an approximate linear continuation of said top edge, said first securing means for urging said top edge into tight engagement with said wearer for preventing flow between said top edge and said wearer; and second securing means attached to said body adjacent to each end of said top edge and positioned to extend generally over the top of said wearer's head in an approximate linear continuation of said bottom edge, said second securing means for urging said bottom edge into tight engagement with said wearer for preventing flow between said bottom edge and said wearer.

19. The mask of claim 11 wherein said filter body comprises a filter media for restricting the flow of aerosols therethrough greater than one-tenth of a micron in size.

20. The mask of claim 11 wherein said securing means comprise a plurality of elastic members.

21. The mask of claim 11 wherein said securing means each comprise first and second elongated, flexible members connected respectively to said body.

22. The mask of claim 11 wherein said filter body comprises an intermediate layer of material that is gas permeable in both directions through said body and liquid impermeable in the direction from outside said body to inside said body.

23. The mask of claim 11 further comprising a guard extending from said bottom edge to cover a portion of said wearer's neck.

24. The mask of claim 11 further comprising an elongated malleable member formed from quarter tempered aluminum disposed within said top edge.

25. A method of making an aerosol mask that includes a plurality of layers of selected materials, the method comprising the steps of:

placing first and second inner mask layers of generally trapezoidal shape in juxtaposition forming the inside surface of the mask;

placing first and second intermediate mask layers of generally trapezoidal shape in juxtaposition to said respective first and second inner mask layers;

placing a first outer mask layer of generally trapezoidal shape in juxtaposition with said first intermediate mask layer forming an upper portion of said mask;

placing a second outer mask layer of generally trapezoidal shape in juxtaposition with said second intermediate mask layer forming a lower portion of said mask;

connecting said upper and lower portions along three sides of said generally trapezoidal shape forming a filter body with an open side;

connecting said first outer mask layer, said first intermediate mask layer and first inner mask layer to form a top edge having opposite ends along said open side;

connecting said second outer mask layer, said second intermediate mask layer and said second inner mask layer to form a bottom edge having opposite ends along said open side with said ends of said top edge joined with said ends of said bottom edge;

securing an elongated malleable member along said top edge;

attaching securing means for holding said mask on a wearer between said ends of said top edge and said bottom edge.

26. The method of claim 25 further comprising the steps of forming a plurality of radii in the sides of said filter body adjacent to said top edge and said bottom edge.

27. The method of claim 26 further comprising the step of attaching two resilient bands to provide said securing means.

28. The method of claim 26 wherein said securing means includes four, flexible, elongated ties and wherein the step of attaching securing means further comprises attaching one end of each tie.

29. The method of claim 25 further comprising the steps of:

attaching a first edge binder to said top edge along with said malleable member; and attaching a second edge binder to said bottom edge.

30. A method of making aerosol masks having an upper mask portion and a lower mask portion from a plurality of layers of selected materials, the method comprising the steps of:

placing elongated sheets of first and second inner mask layers having substantially the same dimensions in juxtaposition for forming the inside surface of the upper and lower mask portions;

placing an elongated sheet of a first outer mask layer in juxtaposition with said first inner mask layer for forming top outside surfaces of said upper and lower mask portions;

placing an elongated sheet of second outer mask layer in juxtaposition with said second outer mask layer for forming bottom outside surfaces of said upper and lower mask portions;

connecting said layers along three sides to form an open side having a top edge and a bottom edge defined by said upper and lower mask portions;

securing an elongated malleable member along the top edge of said upper mask portion; and attaching securing means for holding the masks on wearers to layers adjacent to junctions between said top and bottom edges.

31. The method of claim 30 further comprising the step of locating said mask shapes at spaced, alternating, interfitting positions along said elongated sheets.

32. The method of claim 31 and also including the step of positioning alternate mask shapes with the top and bottom edges located adjacent to longitudinal edges of said elongated sheets.

33. The method of claim 31 and also including the steps of:

folding a first edge binder over said top edge;

attaching said first edge binder to said top edge enfolding said malleable member;

folding a second edge binder over said bottom edge; and attaching said second edge binder to said bottom edge.

34. The method of claim 33 wherein said securing means includes four, flexible, elongated ties and wherein the step of attaching said securing means includes attaching one end of each tie.

35. The method of claim 30 and also including the steps of:

folding a first edge binder over said top edge;

attaching said first edge binder to said top edge enfolding said malleable member;

folding a second edge binder over said bottom edge; and attached said second edge binder to said bottom edge.

36. The method of claim 35 wherein said securing means includes two resilient bands and wherein the step of attaching said securing means includes attaching each end of each band.

37. The method of claim 30 and also including the steps of:

placing a first mask intermediate layer comprising a filter media between said first inner mask layer and said first outer mask layer; and placing a second mask intermediate layer comprising a filter media between said second inner mask layer and said second outer mask layer.

38. The method of claim 30 further comprising the steps of:

attaching a first one-piece elongated tie at one of said junctions between said top and bottom edges intermediate the ends of said first one-piece tie; and attaching a second one-piece elongated tie at the other junction between said top and bottom edges intermediate the ends of said second one-piece tie.

* * * * *

UNITED STATES PATENT AND TRADEMARK OFFICE

CERTIFICATE OF CORRECTION

PATENT NO. 5,322,061

DATED June 21, 1994

INVENTOR(S) Brunson

It is certified that error appears in the above-identified patent and that said Letters Patent is hereby corrected as shown below:

Column 2, line 5,

Title Page, OTHER PUBLICATIONS, after Annotated Figure from U.S. 4,419,993 insert --"The Mask Collection" by Tecnol, Reprinted from AORN Journal, 1987.--

--AO Safety Products brochure and sample product, Dust Demon Foldable, Reusable/Disposable Respirator.--

--Glendale brochure, dustbuster Comfort Plus Full Dust and Mist Protection, 7/92/10M.--

Column 5, line 44, after "body", delete "4" and insert --14-- therefor.

Signed and Sealed this

Third Day of January, 1995

Bruce Lehman

*Attest:*

BRUCE LEHMAN

*Attesting Officer*

*Commissioner of Patents and Trademarks*

US005322061B1

REEXAMINATION CERTIFICATE (3527th)

United States Patent [19]

Brunson

[11] B1 5,322,061

[45] Certificate Issued Jun. 2, 1998

[54] DISPOSABLE AEROSOL MASK

[75] Inventor: Kevin K. Brunson, Argyle, Tex.

[73] Assignee: Tecnol Medical Products, Inc., North Richland Hills, Tex.

Reexamination Request:
No. 90/004,348, Aug. 30, 1996

Reexamination Certificate for:

| | |
|---|---|
| Patent No.: | **5,322,061** |
| Issued: | **Jun. 21, 1994** |
| Appl. No.: | **991,154** |
| Filed: | **Dec. 16, 1992** |

Certificate of Correction issued Jan. 3, 1995.

[51] Int. Cl.[6] ..... A62B 7/10

[52] U.S. Cl. ..... 128/206.13; 128/863; 2/424

[58] Field of Search ..... 128/863, 206.13, 128/206.12, 206.19, 201.17, 201.25, 201.29; 2/DIG. 7, 184, 336, 243 A, 243 R

[56] References Cited

U.S. PATENT DOCUMENTS

| | | | |
|---|---|---|---|
| D. 249,072 | 8/1978 | Revoir | D29/8 |
| D. 285,733 | 9/1986 | Cooper | D29/8 |
| D. 319,111 | 8/1991 | Sandel et al. | D29/9 |
| 1,987,922 | 1/1935 | Blatt | 128/863 |
| 2,012,505 | 8/1935 | Goldsmith | 128/863 |

(List continued on next page.)

FOREIGN PATENT DOCUMENTS

| | | | |
|---|---|---|---|
| 5033179 | 8/1979 | Australia . | |
| 1085259 | 9/1980 | Canada . | |
| 0355444 | 2/1990 | European Pat. Off. . | |
| 0391725 | 4/1990 | European Pat. Off. . | |
| 0391726 | 10/1990 | European Pat. Off. | B01D 39/14 |
| 0515986 | 12/1992 | European Pat. Off. . | |
| 0606686 | 7/1994 | European Pat. Off. | A41D 13/00 |
| 867791 | 11/1941 | France . | |

(List continued on next page.)

OTHER PUBLICATIONS

European Search Report dated Feb. 1, 1997 to I. R. Harris/London, ref. E395 4; Patent No. 95305033.3, Tecnol Medical Products, Inc., 4 pages.

Synopsis of Citation 3/Japanese Utility Model laid–open No. 84,253/1988; Inventor: Takao Miyake, Shizuoka Prefecture, Japan; Applicant; San Emu Package, Kabushiki kaisha, Shizuoka Prefecture, Japan; Application filed: Nov. 20, 1986, 5 pages.

AO Safety Products, *The R1050 DustDemon Foldable, Reusable/Disposable Respirator,* undated, 2–sided/2pages.

Tecnol Fluid Shield, *The First Mask Specifically Designed to Resist Fluid Penetration,* undated, 5 pages.

Tecnol, The Tecnol Mask Collection . . . *The Collection of Quality and Style,* Nov. 1992, 1 page.

Tecnol, Fluidshield Mask Collection, *Fluidshield Procedure Masks/Fluidshield Surgical Masks,* undated, 1 pg.

Wayne T. Davis, PhD., American Journal of Infection Control vol. 19, No. 1, *Filtration efficiency of surgical face masks: The need for more meaningful standards.*, Feb., 1991, 3 pages.

Racal Health & Safety, Inc, *Delta Disposable Respirators,* Mar. 1993, 4 pages.

European Search Report to Uexkull & Stolberg, May 10, 1995, ref. P39035/Appl. No. EP 94250231, 5 pages.

Australian Industrial Property Organisation, Letter to F B Rice & Co, dated Jul. 12, 1995, citing AU 50331/79, 4 pages.

*Primary Examiner*—Aaron J. Lewis

[57] ABSTRACT

A disposable mask that includes a filter media capable of filtering particles of a size appropriate for its purposes, while providing excellent breathability. The mask is formed from multiple layers of filtration material having the general configuration of a trapezoid. The mask is secured by straps to the head of a wearer. The straps are arranged to be approximately coextensive with a line extending from the edges which define the opening of the mask so that the edges are pulled into tight sealing engagement with the face of the wearer.

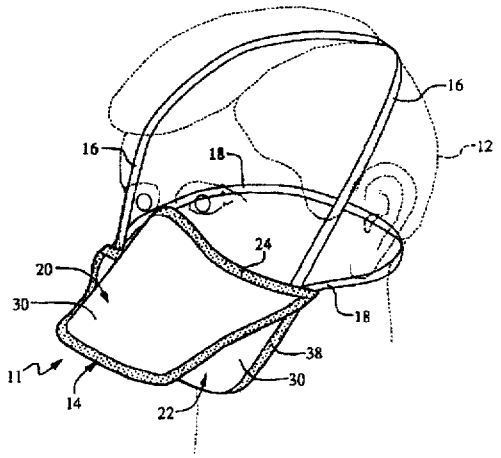

U.S. PATENT DOCUMENTS

| | | | |
|---|---|---|---|
| 2,116,241 | 5/1938 | Heumann | 128/863 |
| 2,227,667 | 1/1941 | Panettiere | 128/863 |
| 2,248,477 | 7/1941 | Lombard | 128/205.25 |
| 2,462,005 | 2/1949 | Schauweker | 128/207.11 |
| 2,494,406 | 1/1950 | Reitano | 128/206.13 |
| 2,556,589 | 6/1951 | Le Duc . | |
| 2,762,368 | 9/1956 | Bloomfield | 128/206.28 |
| 3,049,121 | 8/1962 | Brumfield et al. | 128/206.14 |
| 3,170,461 | 2/1965 | Watts, Jr. | 128/863 |
| 3,220,409 | 11/1965 | Liloia et al. | 128/206.19 |
| 3,288,138 | 11/1966 | Sachs | 128/863 |
| 3,316,904 | 5/1967 | Wall et al. | 128/206.12 |
| 3,620,214 | 11/1971 | Thackston | 128/206.19 |
| 3,664,335 | 5/1972 | Boucher et al. | 128/206.19 |
| 3,688,768 | 9/1972 | Reimschussel et al. | 128/206.12 |
| 3,779,244 | 12/1973 | Weeks, Jr. et al. | 128/206.19 |
| 3,888,246 | 6/1975 | Lauer | 128/201.17 |
| 3,890,966 | 6/1975 | Aspelin et al. | 128/201.17 |
| 3,929,135 | 12/1975 | Thompson | 609/385.1 |
| 3,932,153 | 1/1976 | Byrns | 55/511 |
| 3,953,566 | 4/1976 | Gore | 264/505 |
| 3,971,369 | 7/1976 | Aspelin et al. | 128/206.19 |
| 3,971,373 | 7/1976 | Braun | 128/206.19 |
| 3,985,132 | 10/1976 | Boyce et al. | 128/206.19 |
| 4,187,390 | 2/1980 | Gore | 174/102 R |
| 4,215,682 | 8/1980 | Kubik et al. | 128/205.29 |
| 4,319,567 | 3/1982 | Magidson | 128/206.19 |
| 4,382,440 | 5/1983 | Kapp et al. | 128/201.25 |
| 4,384,577 | 5/1983 | Huber et al. | 128/206.19 |
| 4,417,575 | 11/1983 | Hilton et al. | 128/206.19 |
| 4,454,881 | 6/1984 | Huber et al. | 128/206.15 |
| 4,495,030 | 1/1985 | Giglia | 162/145 |
| 4,510,931 | 4/1985 | Henderson et al. | 128/202.28 |
| 4,536,440 | 8/1985 | Berg | 428/284 |
| 4,547,420 | 10/1985 | Krueger et al. | 428/229 |
| 4,551,378 | 11/1985 | Carey, Jr. | 428/198 |
| 4,616,647 | 10/1986 | McCreadie | 128/206.19 |
| 4,635,628 | 1/1987 | Hubbard et al. | 128/201.17 |
| 4,641,645 | 2/1987 | Tayebi | 128/206.19 |
| 4,688,566 | 8/1987 | Boyce . | |
| 4,750,482 | 6/1988 | Sieverding | 128/156 |
| 4,797,956 | 1/1989 | Boyce | 2/431 |
| 4,807,619 | 2/1989 | Dyrud et al. | 128/206.16 |
| 4,827,924 | 5/1989 | Japuntich | 428/206.12 |
| 4,850,347 | 7/1989 | Skov | 128/206.16 |
| 4,856,509 | 8/1989 | Lemelson | 128/206.19 |
| 4,873,972 | 10/1989 | Magidson et al. | 128/206.12 |
| 4,883,052 | 11/1989 | Weiss et al. | 128/205.27 |
| 4,920,960 | 5/1990 | Hubbard et al. | 128/206.12 |
| 4,941,470 | 7/1990 | Hubbard et al. | 128/206.13 |
| 4,944,294 | 7/1990 | Borek, Jr. . | |
| 4,945,574 | 8/1990 | Dagher | 2/9 |
| 4,966,140 | 10/1990 | Herzberg | 128/206.19 |
| 5,003,633 | 4/1991 | Itoh | 2/9 |
| 5,012,805 | 5/1991 | Muckerheide | 128/205.28 |
| 5,020,533 | 6/1991 | Hubbard et al. . | |
| 5,025,506 | 6/1991 | Huang | 2/206 |
| 5,033,115 | 7/1991 | Bowling et al. | 2/51 |
| 5,035,240 | 7/1991 | Braun et al. | 128/205.27 |
| 5,094,236 | 3/1992 | Tayebi | 128/206.12 |
| 5,107,547 | 4/1992 | Scheu . | |
| 5,322,061 | 6/1994 | Brunson | 128/206.13 |
| 5,368,021 | 11/1994 | Beard et al. | 128/205.12 |
| 5,406,943 | 4/1995 | Hubbard et al. | 128/206.12 |
| 5,419,318 | 5/1995 | Tayebi | 128/205.27 |

FOREIGN PATENT DOCUMENTS

| | | | |
|---|---|---|---|
| 2471792 | 6/1981 | France . | |
| 655814 | 1/1938 | Germany . | |
| 688227 | 2/1940 | Germany . | |
| 2717968 | 11/1976 | Germany . | |
| 7706660 | 6/1977 | Netherlands . | |
| 4789 | 8/1912 | United Kingdom . | |
| 5104 | of 1913 | United Kingdom . | |
| 892262 | 3/1962 | United Kingdom . | |
| 9674455 | 8/1964 | United Kingdom . | |
| 1049604 | 11/1966 | United Kingdom | A62B 7/10 |
| 1433504 | 4/1976 | United Kingdom | A62B 18/02 |
| 1473924 | 5/1977 | United Kingdom | A62B 18/02 |
| 1556679 | 11/1979 | United Kingdom . | |
| 2028664 | 3/1980 | United Kingdom . | |
| 1588442 | 4/1981 | United Kingdom . | |
| 2059782 | 4/1981 | United Kingdom . | |
| 2072516 | 10/1981 | United Kingdom . | |
| 2103491 | 2/1983 | United Kingdom . | |
| 8101019 | 4/1981 | WIPO | D04H 13/00 |
| 8103266 | 11/1981 | WIPO | A41D 13/00 |
| 8601734 | 3/1986 | WIPO . | |
| 8900874 | 2/1989 | WIPO | A62B 18/02 |
| 8910106 | 11/1989 | WIPO . | |
| 9108829 | 6/1991 | WIPO . | |

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 14 is cancelled.

Claims 1, 2, 4, 11, 15–17, 20, 21, 25, 27, 28, 30, 33 and 34 are determined to be patentable as amended.

Claims 3, 5–10, 12, 13, 18, 19, 22, 23, 24, 26, 29, 31, 32 and 35–38, dependent on an amended claim, are determined to be patentable.

1. A disposable mask comprising:

a filter body having an opening sized to cover the nose and mouth of a wearer, said *filter* body having top and bottom edges with said top edge arranged to extend across the nose of said wearer and said bottom edge arranged to extend under the chin of said wearer;

said top edge having ends opposite from each other and said bottom edge having ends opposite from each other;

first securing means attached to said *filter* body adjacent to each end of said top edge *and said bottom edge* and arranged to extend generally about the back of the head of said wearer in an approximate linear continuation of said top edge, said first securing means for urging said top edge into tight engagement with said wearer for preventing *fluid* flow between said top edge and said wearer; [and]

second securing means attached to said body adjacent to each end of said *top edge and said* bottom edge and arranged to extend generally over the top of said wearer's head in an approximate linear continuation of said bottom edge, said second securing means for urging said bottom edge into tight engagement with said wearer for preventing *fluid* flow between said bottom edge and said wearer[.];

*one end of said top edge bonded with one end of said bottom edge and the other end of said top edge bonded with the other end of said bottom edge to define in part said opening for said filter body; and*

*said first securing means and said second securing means attached to said filter body between said bonded ends of said top edge and said bottom edge.*

2. The mask of claim 1 wherein said filter body includes:

an upper portion of generally trapezoidal configuration having a longer side forming said top edge;

a lower portion of generally trapezoidal configuration having a longer side forming said bottom edge; [said ends of said top edge being joined with said ends of said bottom edge to define in part said opening in said filter body; and] *and* said upper and lower portions being joined along all remaining sides of said filter body.

4. The mask of claim [3] *5*, further comprising said malleable member located in the center of said top edge and having a length corresponding to more than 50% and less than 70% of the length of said top edge.

11. A disposable mask comprising:

a filter body having an opening sized to cover the nose and mouth of a wearer, said filter body having top and bottom edges with said top edge arranged to extend across the nose and cheeks of said wearer, and said bottom edge arranged to extend under the chin of said wearer;

said top edge having ends opposite from each other and said bottom edge having ends opposite from each other, said ends of said top edge being joined with said ends of said bottom edge to define in part said opening in said filter body;

said filter body comprising an upper portion of generally trapezoidal configuration having a longer side forming said top edge and a lower portion of generally trapezoidal configuration having a longer side forming said bottom edge;

said upper and lower portions being joined along all remaining sides; and a plurality of radii formed on opposite sides of said filter body *including a first radius that curves inward towards said top edge and a second radius that curves outward from said filter body.*

15. The mask of claim [14] *11* wherein said filter body further comprises said second radius tangent to said first radius.

16. [The mask of claim 11 further comprising:] *A disposable mask comprising:*

*a filter body having an opening sized to cover the nose and mouth of a wearer, said filter body having top and bottom edges with said top edge arranged to extend across the nose and cheeks of said wearer, and said bottom edge arranged to extend under the chin of said wearer;*

*said top edge having ends opposite from each other and said bottom edge having ends opposite from each other, said ends of said top edge being joined with said ends of said bottom edge to define in part said opening in said filter body;*

*said filter body comprising an upper portion of generally trapezoidal configuration having a longer side forming said top edge and a lower portion of generally trapezoidal configuration having a longer side forming said bottom edge;*

*said upper and lower portions being joined along all remaining sides;*

*at least one radius formed on each opposite side of said filter body adjacent to said top edge and said bottom edge;* a first securing means and a second securing means for attaching the mask to the face of said wearer; and said first securing means and said second securing means attached to said filter body between said ends of said top edge and said bottom edge.

17. The mask of claim 16 further comprising said ends of said first securing means and said second securing means disposed adjacent to each other between said ends of said top edge and said bottom edge [respectively].

20. The mask of claim 11 [wherein said securing means comprise] *further comprising* a plurality of elastic members *for attaching the mask to the face of said wearer.*

21. The mask of claim [11] *16* wherein said securing means each comprise first and second elongated, flexible members connected respectively to said body.

25. A method of making an aerosol mask that includes a plurality of layers of selected materials, the method comprising the steps of:

placing first and second inner mask layers of generally trapezoidal shape in juxtaposition forming the inside surface of the mask;

placing first and second intermediate mask layers of generally trapezoidal shape in juxtaposition to said respective first and second inner mask layers;

placing a first outer mask layer of generally trapezoidal shape in juxtaposition with said first intermediate mask layer forming an upper portion of said mask;

placing a second outer mask layer of generally trapezoidal shape in juxtaposition with said second intermediate mask layer forming a lower portion of said mask;

connecting said upper and lower portions along three sides of said generally trapezoidal shape forming a filter body with an open side;

connecting said first outer mask layer, said first intermediate mask layer and first inner mask layer to form a top edge having opposite ends along said open side;

connecting said second outer mask layer, said second intermediate mask layer and said second inner mask layer to form a bottom edge having opposite ends along said open side with said ends of said top edge joined with said ends of said bottom edge;

securing an elongated malleable member along said top edge;

attaching *a first* securing means for holding said mask on a wearer between said ends of said top edge and said bottom edge*; and*

*attching a second securing means for holding said mask on said wearer between said ends of said top edge and said bottom edge.*

27. The method of claim 26 further comprising the [step] *steps* of attaching [two] *a first* resilient [bands] *band* to provide said *first* securing means *and attaching a second resilient band to provide said second securing means.*

28. The method of claim 26 wherein said *first and second* securing means includes four, flexible, elongated ties and wherein [the step] *said steps* of attaching *said first and second* securing means further comprises attaching one end of each tie.

30. A method of making *a disposable* aerosol [masks] *face mask* having an upper mask portion and a lower mask portion from a plurality of layers of selected materials, the method comprising the steps of:

placing elongated sheets of first and second inner mask layers having substantially the same dimensions in juxtaposition for forming the inside surface of the upper and lower mask portions;

placing an elongated sheet of a first outer mask layer in juxtaposition with said first inner mask layer for forming top outside surfaces of said upper and lower mask portions;

placing an elongated sheet of second outer mask layer in juxtaposition with said second outer mask layer for forming bottom outside surfaces of said upper and lower mask portions;

connecting said layers along three sides to form [an open side having] *a filter body having a generally trapezoidal shape with three closed sides and an opening defined in part by* a top edge *of said upper mask portion* and a bottom edge [defined by said upper and lower mask portions] *of said lower mask portion extending along a fourth side of said filter body;*

*forming a plurality of radii in opposite closed sides of said filter body extending from said opening;* securing an elongated malleable member along [the] *said* top edge of said upper mask portion; and attaching securing means *to said filter body* for holding [the masks on wearers to layers adjacent to junctions between said top and bottom edges] *said mask on the face of a wearer.*

33. The method of claim 31 and also including the steps of:

folding a first edge binder over said top edge;

attaching said first edge binder to said top edge [enfolding] *over* said malleable member;

folding a second edge binder over said bottom edge; and

[attached] *attaching* said second edge binder to said bottom edge.

34. The method of claim [33] *30* wherein said securing means includes four, flexible, elongated ties and wherein the step of attaching said securing means includes attaching one end of each tie.

* * * * *